US009872372B2

(12) United States Patent
Ueda et al.

(10) Patent No.: US 9,872,372 B2
(45) Date of Patent: Jan. 16, 2018

(54) EXTREME ULTRAVIOLET LIGHT GENERATION DEVICE

(71) Applicant: Gigaphoton Inc., Tochigi (JP)

(72) Inventors: Atsushi Ueda, Oyama (JP); Shinji Nagai, Oyama (JP); Yoshifumi Ueno, Oyama (JP); Tamotsu Abe, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/379,230

(22) Filed: Dec. 14, 2016

(65) Prior Publication Data

US 2017/0094767 A1 Mar. 30, 2017

Related U.S. Application Data

(63) Continuation of application No. PCT/JP2014/068582, filed on Jul. 11, 2014.

(51) Int. Cl.

*H05G 2/00* (2006.01)
*G21K 1/14* (2006.01)
*G21K 1/06* (2006.01)

(52) U.S. Cl.

CPC ..... *H05G 2/008* (2013.01); *G21K 1/067* (2013.01)

(58) Field of Classification Search

CPC ..... H05G 2/008; H05G 2/003; H05G 2/001; G03F 7/70033; G03F 7/70916; G03F 7/70983; G03F 7/70925; G21K 1/093; G21K 1/14

USPC ... 250/504 R, 493.1, 423 R, 396 ML, 505.1, 250/283, 364, 461.1; 315/111.21, 111.41

See application file for complete search history.

(56) References Cited

U.S. PATENT DOCUMENTS 7,217,941 B2 * 5/2007 Rettig ..... B82Y 10/00 134/1.1
7,271,401 B2 * 9/2007 Imai ..... B82Y 10/00 250/423 R
7,705,333 B2 * 4/2010 Komori ..... G21K 1/14 156/345.48
8,067,756 B2 * 11/2011 Ueno ..... H05G 2/003 250/364
8,436,328 B2 * 5/2013 Yanagida ..... G03F 7/70033 250/396 ML
8,669,543 B2 * 3/2014 Yanagida ..... H05G 2/003 250/365
9,253,866 B2 * 2/2016 Someya ..... H05G 2/008

(Continued)

FOREIGN PATENT DOCUMENTS

JP 2003-142296 A 5/2003
JP 2005-235883 A 9/2005

(Continued)

OTHER PUBLICATIONS

International Search Report issued in PCT/JP2014/068582; dated Oct. 28, 2014.

*Primary Examiner* — David A Vanore
(74) *Attorney, Agent, or Firm* — Studebaker & Brackett PC

(57) ABSTRACT

An extreme ultraviolet light generation device is to generate extreme ultraviolet light by irradiating a target with a pulse laser beam and thereby turning the target into plasma. The device may include a chamber, a magnet configured to form a magnetic field in the chamber, and an ion catcher including a collision unit disposed so that ions guided by the magnetic field collide with the collision unit.

20 Claims, 16 Drawing Sheets

(56) References Cited

U.S. PATENT DOCUMENTS 9,465,307 B2* 10/2016 Mizoguchi ..... G03F 7/70925
2007/0228298 A1* 10/2007 Komori ..... H05G 2/003 250/493.1
2008/0083887 A1 4/2008 Komori et al.
2008/0087840 A1* 4/2008 Ueno ..... B82Y 10/00 250/396 ML
2009/0261242 A1* 10/2009 Ueno ..... G03F 7/70033 250/283
2009/0261277 A1 10/2009 Soumagne et al.
2009/0289205 A1* 11/2009 Moriya ..... G02B 5/0891 250/504 R
2010/0032590 A1 2/2010 Bykanov et al.
2010/0078579 A1* 4/2010 Endo ..... H05G 2/001 250/504 R
2010/0213395 A1 8/2010 Ueno et al.
2010/0243922 A1* 9/2010 Asayama ..... H05G 2/003 250/504 R
2011/0101863 A1* 5/2011 Komori ..... G03F 7/70033 315/111.41
2011/0253913 A1 10/2011 Nagai et al.
2011/0266468 A1* 11/2011 Nagai ..... G03F 7/70033 250/504 R
2011/0297852 A1* 12/2011 Kameda ..... B82Y 10/00 250/504 R
2012/0119116 A1* 5/2012 Kakizaki ..... G03F 7/70033 250/504 R
2012/0243566 A1* 9/2012 Hori ..... H01S 3/10061 372/27
2012/0248343 A1* 10/2012 Nagai ..... H05G 2/003 250/504 R
2013/0034116 A1* 2/2013 Nowak ..... H05G 2/008 372/27
2014/0077099 A1* 3/2014 Hori ..... H05G 2/008 250/458.1
2014/0098830 A1* 4/2014 Yabu ..... H05G 2/005 372/30
2015/0296604 A1* 10/2015 Nagai ..... H05G 2/006 250/504 R
2016/0242268 A1* 8/2016 McGeoch ..... H05G 2/005
2017/0094767 A1* 3/2017 Ueda ..... G21K 1/067

FOREIGN PATENT DOCUMENTS

JP 2008-277481 A 11/2008
JP 2010-171405 A 8/2010
JP 4937643 B2 5/2012
JP 2012-146613 A 8/2012
JP 2013-084892 A 5/2013
JP 5312837 B2 10/2013

* cited by examiner

EXTREME ULTRAVIOLET LIGHT GENERATION DEVICE

TECHNICAL FIELD

The present disclosure relates to an extreme ultraviolet light generation device.

BACKGROUND ART

In recent years, as semiconductor processes become finer, transfer patterns for use in photolithographies of semiconductor processes have rapidly become finer. In the next generation, microfabrication at 70 nm to 45 nm, and further, microfabrication at 32 nm or less will be demanded. In order to meet the demand for microfabrication at 32 nm or less, for example, the development of an exposure apparatus in which a system for generating EUV (extreme ultraviolet) light at a wavelength of approximately 13 nm is combined with a reduced projection reflective optics is expected.

Three types of EUV light generation systems have been proposed, which include an LPP (laser produced plasma) type system using plasma generated by irradiating a target material with a laser beam, a DPP (discharge produced plasma) type system using plasma generated by electric discharge, and an SR (synchrotron radiation) type system using orbital radiation.

SUMMARY

An extreme ultraviolet light generation device according to an aspect of the present disclosure may be an extreme ultraviolet light generation device for generating extreme ultraviolet light by irradiating a target with a pulse laser beam and thereby turning the target into plasma, and may include: a chamber; a magnet configured to form a magnetic field in the chamber; and an ion catcher including a collision unit disposed so that ions guided by the magnetic field collide with the collision unit.

BRIEF DESCRIPTION OF DRAWINGS

Selected embodiments of the present disclosure will be described below with reference to the accompanying drawings by way of example.

DESCRIPTION OF EMBODIMENTS

Contents

Figure 1:
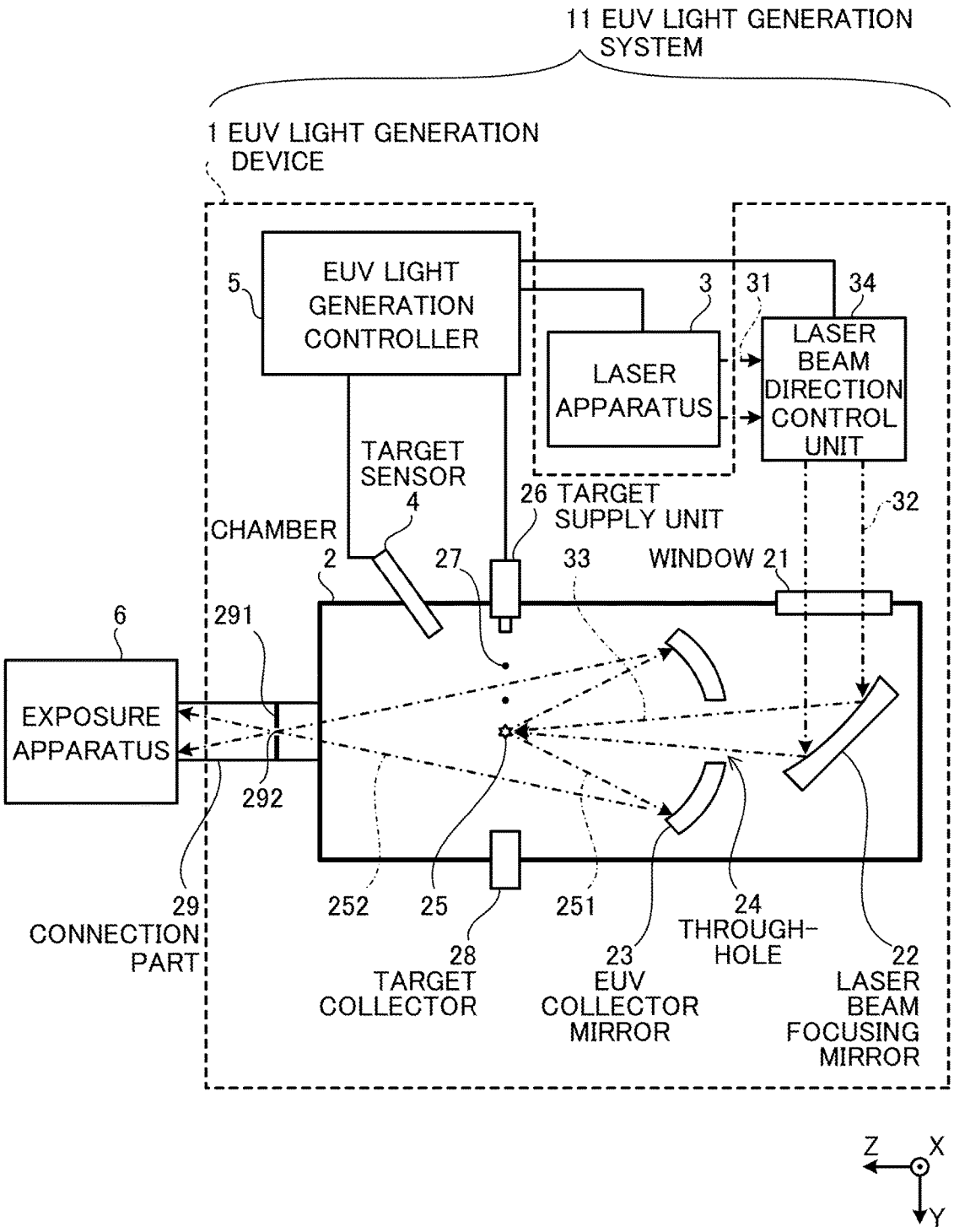
FIG. 1 schematically illustrates an exemplary configuration of an LPP type EUV light generation system.

1. Overview
2. Terms
3. Overview of EUV Light Generation System
3.1 Configuration
3.2 Operation
4. EUV Light Generation Device Including Ion Catcher
4.1 Overall Configuration
4.2 Laser Beam Direction Control Unit
4.3 Focusing Optical System
4.4 Magnets
4.5 Ion Catcher
5. EUV Light Generation Device Including Tubular Ion Catcher
6. EUV Light Generation Device Whose Ion Catcher Includes Exhaust Pump
6.1 Gas Supply System
6.2 Ion Catcher
7. EUV Light Generation Device Whose Ion Catcher Includes Gate Valves
8. EUV Light Generation Device Whose Ion Catcher Includes Powder Pump
9. EUV Light Generation Device Including Ion Catcher Constituted by Tubular Member
10. EUV Light Generation Device Including Ion Catcher Disposed in Obscuration Area
11. Shapes of Tubular Members Selected embodiments of the present disclosure will be described in detail below with reference to the accompanying drawings. The embodiments to be described below are merely illustrative in nature and do not limit the scope of the present disclosure. Further, the configuration(s) and operation(s) described in each embodiment are not all essential in implementing the present disclosure. Corresponding elements may be referenced by corresponding reference numerals and characters, and duplicate descriptions thereof may be omitted.

1. Overview

In an LPP-type EUV light generation device, a target supply unit may output a target so that the target reaches a plasma generation region. A laser apparatus may irradiate the target with a pulse laser beam at the point in time when the target reaches the plasma generation region. This may cause the target to be turned into plasma, and EUV light may be emitted from the plasma. The EUV light thus emitted may be reflected and concentrated by an EUV collector mirror.

The plasma may contain high-energy ions. The ions contained in the plasma may be caught by an ion catcher. However, a collision of the high-energy ions against the ion catcher may cause the ions to rebound and scatter or may cause a surface of the ion catcher to be sputtered so that sputtered particles scatter. The ions or sputtered particles having scattered may adhere to an optical element in a chamber, such as the EUV collector mirror, to deteriorate the characteristics of the optical element.

A collision of electrically neutral particles, as well as the ions, against the ion catcher may deliver a similar result. Such electrically neutral particles are hereinafter referred to as "neutral particles". Note here that the ion catcher may be one configured to catch the ions and/or the neutral particles.

According to an aspect of the present disclosure, the EUV light generation device may include: a magnet configured to form a magnetic field in the chamber; and an ion catcher including a collision unit disposed so that ions guided by the magnetic field collide with the collision unit. The ion catcher may include a plurality of collision surfaces disposed to be inclined with respect to the magnetic field.

2. Terms

Several terms used in the present disclosure will be described below.

A "plasma generation region" may refer to a predetermined region where generation of the plasma for generating the EUV light begins.

A "Y direction" may substantially coincide with a direction of movement of a target 27.

A "Z direction" may be a direction perpendicular to the Y direction. The Z direction may substantially coincide with a traveling direction of a pulse laser beam 33. The Z direction may also substantially coincide with a travelling direction of reflected light 252 reflected by an EUV collector mirror 23.

An "X direction" may be a direction perpendicular to both the Y direction and the Z direction. The X direction may substantially coincide with a direction of a central axis of a magnetic field that is formed by magnets 6*a* and 6*b*.

3. Overview of EUV Light Generation System 3.1 Configuration

FIG. 1 schematically illustrates an exemplary configuration of an LPP type EUV light generation system. An EUV light generation device 1 may be used with at least one laser apparatus 3. Hereinafter, a system that includes the EUV light generation device 1 and the laser apparatus 3 may be referred to as an EUV light generation system 11. As shown in FIG. 1 and described in detail below, the EUV light generation device 1 may include a chamber 2 and a target supply unit 26. The chamber 2 may be sealed airtight. The target supply unit 26 may be mounted onto the chamber 2, for example, to penetrate a wall of the chamber 2. A target material to be supplied by the target supply unit 26 may include, but is not limited to, tin, terbium, gadolinium, lithium, xenon, or a combination of any two or more of them.

The chamber 2 may have at least one through-hole formed in its wall. A window 21 may be located at the through-hole. A pulse laser beam 32 that is outputted from the laser apparatus 3 may travel through the window 21. In the chamber 2, the EUV collector mirror 23 having a spheroidal reflective surface may be provided. The EUV collector mirror 23 may have a first focusing point and a second focusing point. The reflective surface of the EUV collector mirror 23 may have a multi-layered reflective film in which molybdenum and silicon are alternately laminated, for example. The EUV collector mirror 23 may be preferably positioned such that the first focusing point is positioned in a plasma generation region 25 and the second focusing point is positioned in an intermediate focus (IF) region 292. The EUV collector mirror 23 may have a through-hole 24, formed at the center thereof, through which the pulse laser beam 33 travels.

The EUV light generation device 1 may further include an EUV light generation controller 5 and a target sensor 4. The target sensor 4 may have an imaging function and detect the presence, actual path, position, speed, and the like of the target 27.

Further, the EUV light generation device 1 may include a connection part 29 for allowing the inside of the chamber 2 to be in communication with the inside of an exposure apparatus 6. A wall 291 having an aperture may be provided in the connection part 29. The wall 291 may be positioned such that the second focusing point of the EUV collector mirror 23 lies in the aperture formed in the wall 291.

The EUV light generation device 1 may also include a laser beam direction control unit 34, a laser beam focusing mirror 22, and a target collector 28 for collecting targets 27. The laser beam direction control unit 34 may include an optical element for defining the direction in which the laser beam travels and an actuator for adjusting the position or the posture of the optical element.

3.2 Operation

With reference to FIG. 1, a pulse laser beam 31 outputted from the laser apparatus 3 may pass through the laser beam direction control unit 34 and be outputted therefrom as the pulse laser beam 32. The pulse laser beam 32 may travel through the window 21 and enter the chamber 2. The pulse laser beam 32 may travel through the inside of the chamber 2 along at least one laser beam path, be reflected by the laser beam focusing mirror 22, and strike at least one target 27 as the pulse laser beam 33.

The target supply unit 26 may be configured to output the target(s) 27 toward the plasma generation region 25 in the chamber 2. The target 27 may be irradiated with at least one pulse of the pulse laser beam 33. Upon being irradiated with the pulse laser beam, the target 27 may be turned into plasma, and emitted light 251 may be emitted from the plasma. The EUV light included in the emitted light 251 may be reflected at a higher reflectance than light at other wavelength regions by the EUV collector mirror 23. The reflected light 252, which includes the EUV light reflected by the EUV collector mirror 23, may be concentrated to the intermediate focus region 292 and be outputted to the exposure apparatus 6. Here, one target 27 may be irradiated with multiple pulses included in the pulse laser beam 33.

The EUV light generation controller 5 may be configured to integrally control the entire EUV light generation system 11. The EUV light generation controller 5 may be configured to process image data and the like of the target 27 captured by the target sensor 4. Further, the EUV light generation controller 5 may be configured to control at least one of the timing when the target 27 is outputted and the direction in which the target 27 is outputted. Furthermore, the EUV light generation controller 5 may be configured to control at least one of the timing when the laser apparatus 3 oscillates, the direction in which the pulse laser beam 32 travels, and the position at which the pulse laser beam 33 is focused. The various controls mentioned above are merely examples, and other controls may be added as necessary.

4. EUV Light Generation Device Including Ion Catcher 4.1 Overall Configuration

Figure 2:
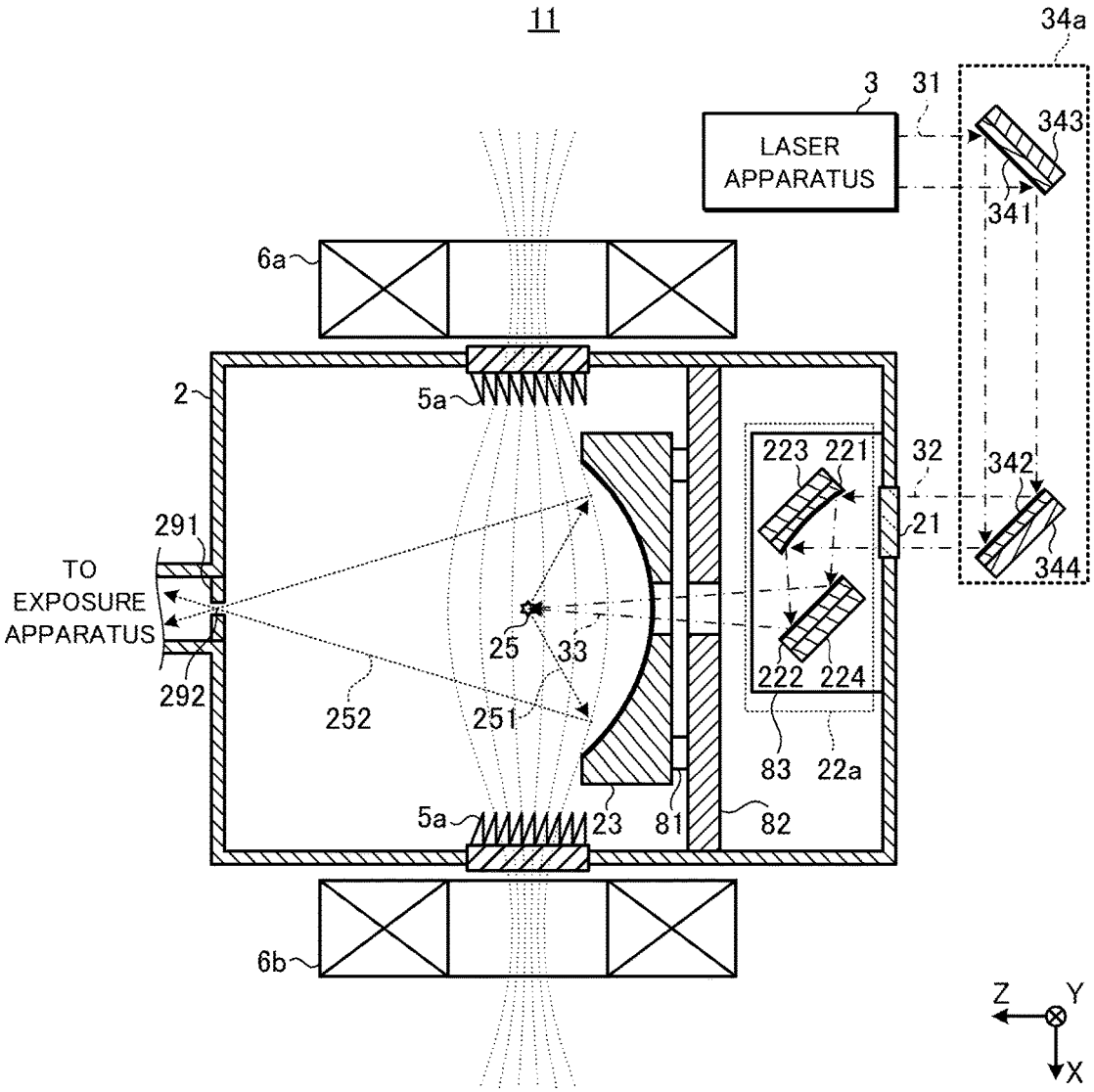
FIG. 2 is a partial cross-sectional view illustrating a configuration of an EUV light generation system according to a first embodiment.

FIG. 2 is a partial cross-sectional view illustrating a configuration of an EUV light generation system 11 according to a first embodiment. FIG. 2 illustrates a cross-section taken along a plane perpendicular to a trajectory of the target 27. The plane perpendicular to the trajectory of the target 27 may be a plane substantially parallel to the ZX plane.

As shown in FIG. 2, a focusing optical system 22*a*, the EUV collector mirror 23, an EUV collector mirror holder 81, plates 82 and 83, and ion catchers 5*a* and 5*a* may be provided inside the chamber 2.

The laser apparatus 3 and a laser beam direction control unit 34*a* may be provided outside the chamber 2.

The laser apparatus 3 may include a $CO_2$ laser device. The laser apparatus 3 may output a pulse laser beam.

4.2 Laser Beam Direction Control Unit

The laser beam direction control unit 34*a* may include high-reflecting mirrors 341 and 342. The high-reflecting mirror 341 may be supported by a holder 343. The high-reflecting mirror 342 may be supported by a holder 344.

The high-reflecting mirror 341 may be provided in an optical path of the pulse laser beam 31 outputted by the laser apparatus 3. The high-reflecting mirror 341 may reflect the pulse laser beam 31 at a high reflectance.

The high-reflecting mirror 342 may be provided in an optical path of the pulse laser beam reflected by the high-reflecting mirror 341. The high-reflecting mirror 342 may reflect the pulse laser beam at a high reflectance to guide this beam as the pulse laser beam 32 into the focusing optical system 22*a*.

4.3 Focusing Optical System

The focusing optical system 22*a* may include an off-axis paraboloidal mirror 221 and a flat mirror 222. The off-axis paraboloidal mirror 221 may be supported by a holder 223. The flat mirror 222 may be supported by a holder 224. The holders 223 and 224 may be fixed to the plate 83. The EUV collector mirror 23 may be fixed to the plate 82 via the EUV collector mirror holder 81. The plates 82 and 83 may be fixed to the chamber 2.

The off-axis paraboloidal mirror 221 may be provided in an optical path of the pulse laser beam 32. The off-axis paraboloidal mirror 221 may reflect the pulse laser beam 32 toward the flat mirror 222. The flat mirror 222 may reflect the pulse laser beam, which has been reflected by the off-axis paraboloidal mirror 221, as the pulse laser beam 33 toward the plasma generation region 25 or the vicinity thereof. The pulse laser beam 33 may be concentrated to the plasma generation region 25 or the vicinity thereof according to the shape of the reflective surface of the off-axis paraboloidal mirror 221.

In the plasma generation region 25 or the vicinity thereof, the target 27 in a form of a single droplet may be irradiated with the pulse laser beam 33. Irradiation of the target 27 with the pulse laser beam 33 may cause the target 27 to turn into plasma to generate EUV light.

4.4 Magnets

Each of the magnets 6*a* and 6*b* may be an electromagnet including a coil. The magnets 6*a* and 6*b* may be disposed in opposed positions across the chamber 2 so that the central axes of their coils coincide with each other. The magnets 6*a* and 6*b* may be configured to be able to form a magnetic field in the chamber. A magnetic field that is formed by the magnets 6*a* and 6*b* may be strongest near the centers of the bores of the respective coils and be slightly weaker between the magnet 6*a* and the magnet 6*b*.

The ions contained in the plasma may receive Lorentz force perpendicular to both the direction of the magnetic field and the direction of movement of the ions when dispersing from the plasma generation region 25. The Lorentz force may cause an actual path of movement of the ions to be in a substantially circular shape as seen from a direction parallel to the magnetic field. That is, the ions may move in a spiral manner along the magnetic field.

4.5 Ion Catcher

The ion catchers 5*a* and 5*a* may be attached to an inner side of the chamber 2. The ion catchers 5*a* and 5*a* may be provided on the central axis of the magnetic field that is formed by the magnets 6*a* and 6*b*.

Figure 3A:
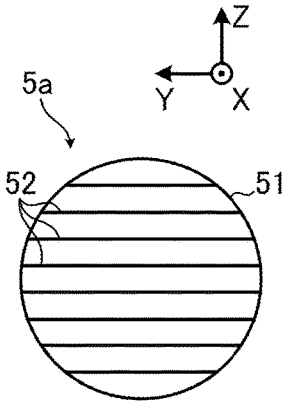
FIGS. 3A to 3C illustrate an exemplary configuration of an ion catcher 5*a* illustrated in FIG. 2.
Figure 3B:
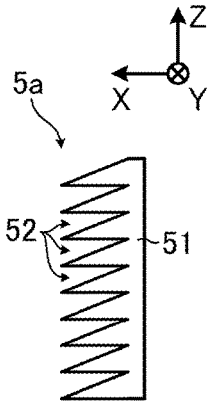
Figure 3C:
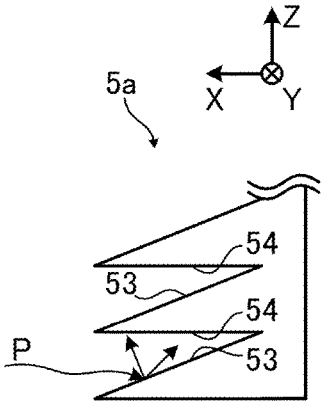

FIGS. 3A to 3C illustrate an exemplary configuration of one ion catcher 5*a* of the ion catchers illustrated in FIG. 2. FIG. 3A is a view of the ion catcher 5*a* as seen from the direction parallel to the magnetic field. FIG. 3B is a side view of the ion catcher 5*a* illustrated in FIG. 3A. FIG. 3C is a partially-enlarged view of the ion catcher 5*a* illustrated in FIG. 3B.

As shown in FIGS. 3A and 3B, the ion catcher 5*a* may include a circular plate 51 and a plurality of deep grooves 52 formed in the circular plate 51. The deep grooves 52 may be triangular in cross-section. As shown in FIG. 3C, these deep grooves 52 may constitute a plurality of collision surfaces 53 and 54. The plurality of collision surfaces 53 may not be parallel to the XY plane but be inclined. The plurality of collision surfaces 53 may not be provided perpendicularly to the circular plate 51 but be inclined toward an upstream side of the optical path of the reflected light 252 reflected by the EUV collector mirror 23. The upstream side of the optical path of the reflected light 252 reflected by the EUV collector mirror 23 may be oriented to a direction from the intermediate focus region 292 toward the center of a reflective surface of the EUV collector mirror 23.

Even when the ions or the neutral particles collide with and are reflected by the collision surfaces 53 as indicated by an arrow P in FIG. 3C, the ions or the neutral particles thus reflected may hit the other collision surfaces 54 and adhere to the collision surfaces 54. The ions or the neutral particles thus reflected are hereinafter referred to as "reflected particles". Alternatively, even when the ions or the neutral particles collide with the collision surfaces 53 as indicated by the arrow P in FIG. 3C to cause the collision surfaces 53 to be sputtered, sputtered particles having jumped out of the collision surfaces 53 may hit the other collision surfaces 54 and adhere to the collision surfaces 54. This makes it possible to prevent the reflected particles or the sputtered particles from scattering into the chamber 2.

Figure 4A:
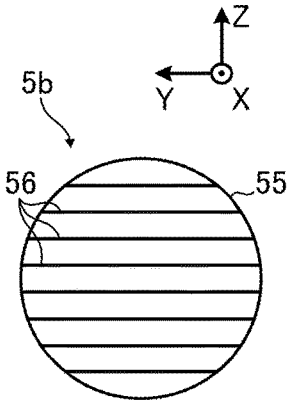
FIGS. 4A to 4C illustrate an exemplary configuration of another ion catcher 5*b*.
Figure 4B:
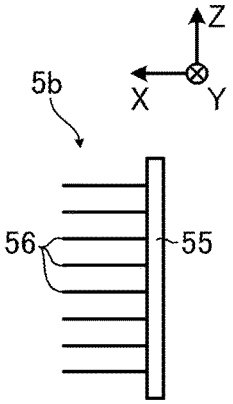
Figure 4C:
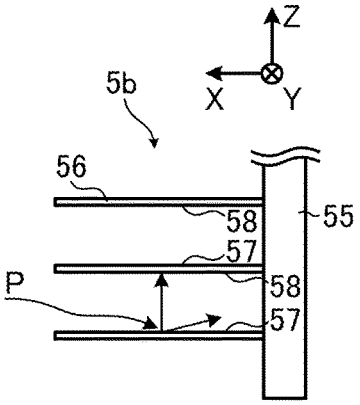

FIGS. 4A to 4C illustrate an exemplary configuration of another ion catcher 5*b*. FIG. 4A is a view of the ion catcher 5*b* as seen from the direction parallel to the magnetic field. FIG. 4B is a side view of the ion catcher 5*b* illustrated in FIG. 4A. FIG. 4C is a partially-enlarged view of the ion catcher 5*b* illustrated in FIG. 4B.

As shown in FIGS. 4A and 4B, the ion catcher 5*b* may include a circular plate 55 and a plurality of plates 56 fixed to the circular plate 55. As shown in FIG. 4C, these plates 56 may constitute a plurality of collision surfaces 57 and 58. The plurality of collision surfaces 57 and 58 may be parallel to the XY plane. The plurality of collision surfaces 57 and 58 may be provided perpendicularly to the circular plate 55.

Even when the ions or the neutral particles collide with and are reflected by the collision surfaces 57 as indicated by an arrow P in FIG. 4C, the reflected particles may hit the other collision surfaces 58 and adhere to the collision surfaces 58. Alternatively, even when the ions or the neutral particles collide with the collision surfaces 57 as indicated by the arrow P in FIG. 4C to cause the collision surfaces 57 to be sputtered, sputtered particles may hit the other collision surfaces 58 and adhere to the collision surfaces 58. This makes it possible to prevent the reflected particles or the sputtered particles from scattering into the chamber 2.

Figure 5:
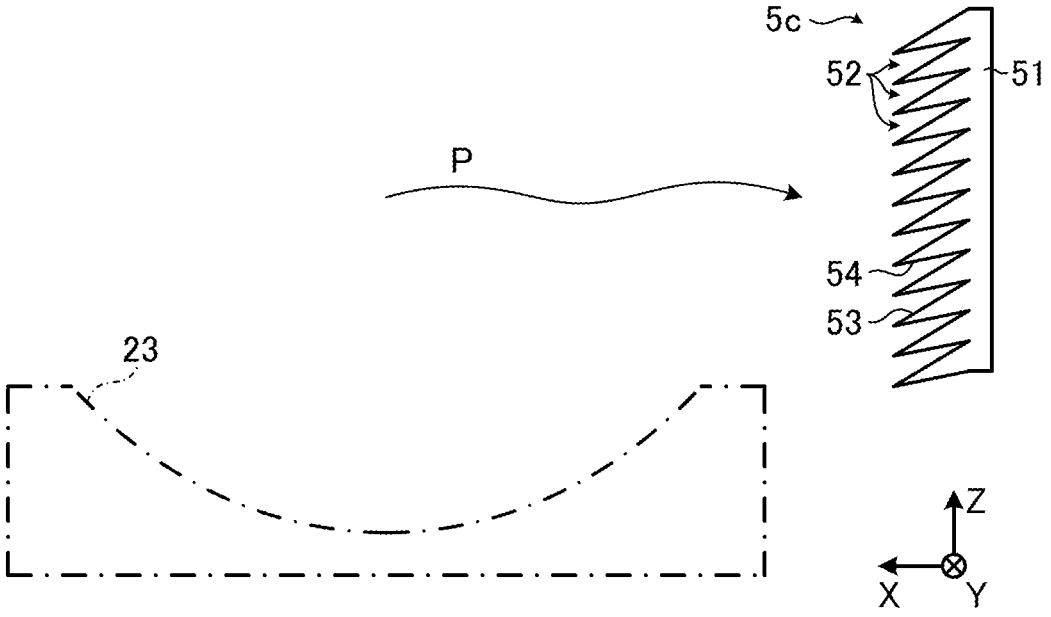
FIG. 5 illustrates an exemplary configuration of still another ion catcher 5*c*.

FIG. 5 illustrates an exemplary configuration of still another ion catcher 5*c*. FIG. 5 also illustrates a positional relationship between the ion catcher 5*c* and the EUV collector mirror 23. Since the reflective surface of the EUV collector mirror 23 faces upward in FIG. 5, a lower side of FIG. 5 may correspond to the upstream side of the reflected light 252 reflected by the EUV collector mirror 23.

The ion catcher 5*c* may include a plate 51 and a plurality of deep grooves 52 formed in the plate 51. The deep grooves 52 may be triangular in cross-section. These deep grooves 52 may constitute a plurality of collision surfaces 53 and 54. As shown in FIG. 5, the plurality of collision surfaces 53 and 34 may be more inclined than the plurality of collision surfaces 53 and 54 illustrated in FIG. 3. The plurality of collision surfaces 54, as well as the plurality of collision surfaces 53, may not be parallel to the XY plane but be inclined.

Figure 6:
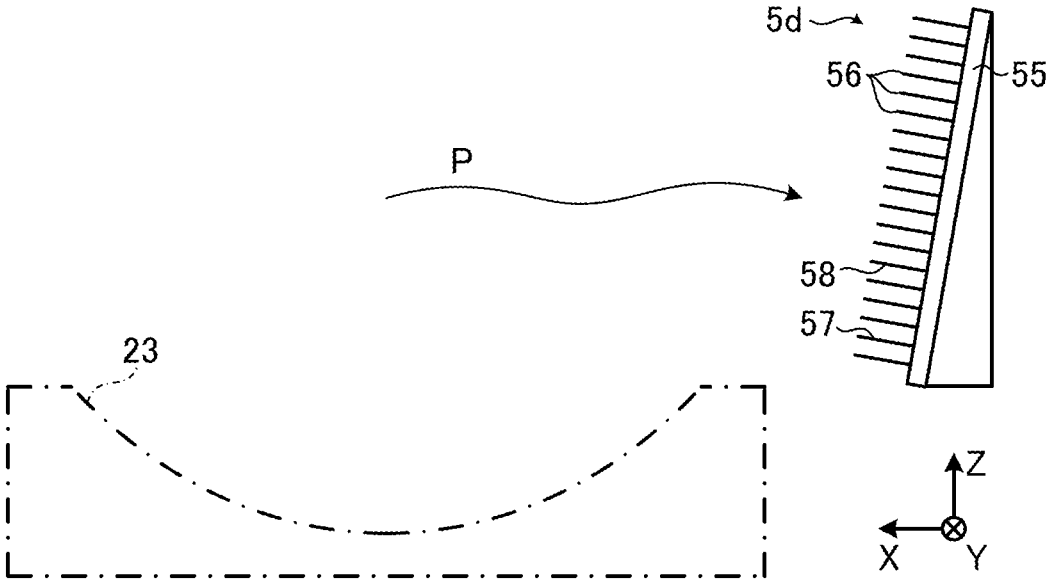
FIG. 6 illustrates an exemplary configuration of still another ion catcher 5*d*.

FIG. 6 illustrates an exemplary configuration of still another ion catcher 5*d*. A lower side of FIG. 6 may correspond to the upstream side of the reflected light 252 reflected by the EUV collector mirror 23.

The ion catcher 5*d* may include an inclined plate 55 and a plurality of plates 56 fixed to the inclined plate 55. These plates 56 may constitute a plurality of collision surfaces 57 and 58. As shown in FIG. 6, the plurality of collision surfaces 57 and 58 may not be parallel to the XY plane but be inclined. The plurality of collision surfaces 57 and 58 may be provided perpendicularly to the circular plate 55. Thus, even when the plurality of collision surfaces 57 and 58 are not inclined with respect to the plate 55, the inclination of the plate 55 may allow the collision surfaces to be preferably inclined.

Figure 7:
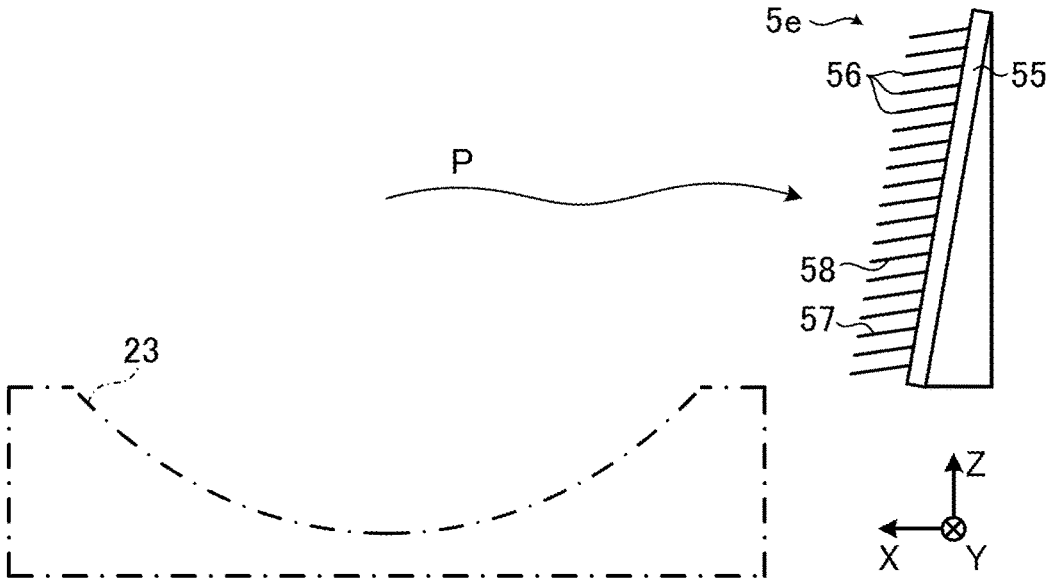
FIG. 7 illustrates an exemplary configuration of still another ion catcher 5*e*.

FIG. 7 illustrates an exemplary configuration of still another ion catcher 5*e*. A lower side of FIG. 7 may correspond to the upstream side of the reflected light 252 reflected by the EUV collector mirror 23.

The ion catcher 5*e* may include an inclined plate 55 and a plurality of plates 56 fixed to the inclined plate 55. These plates 56 may constitute a plurality of collision surfaces 57 and 58. As shown in FIG. 7, the plurality of collision surfaces 57 and 58 may not be parallel to the XY plane but be inclined. The plurality of collision surfaces 57 and 58 may not be provided perpendicularly to the circular plate 55 but be inclined toward the upstream side of the optical path of the reflected light 252 reflected by the EUV collector mirror 23.

Figure 8:
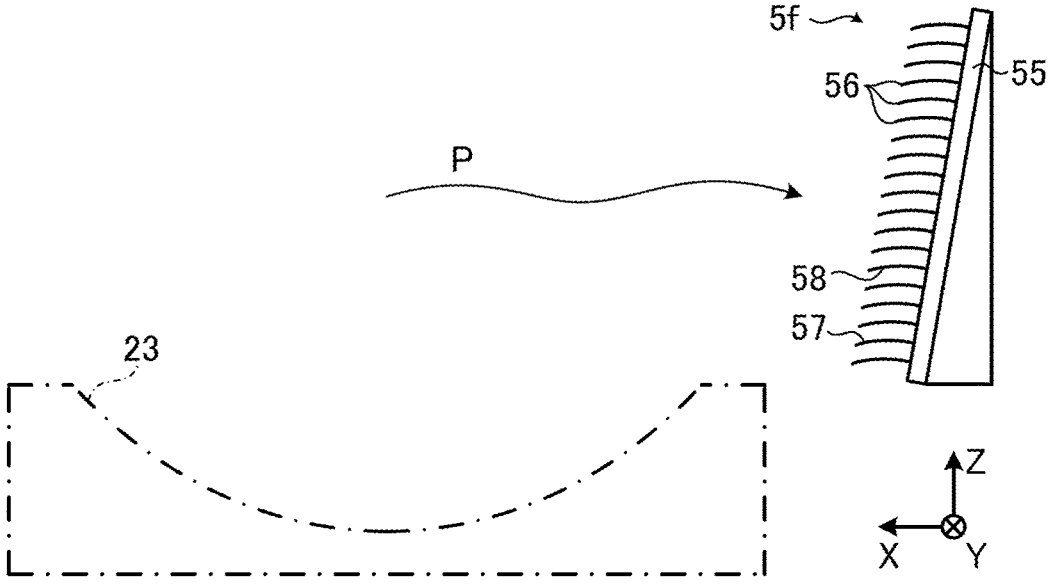
FIG. 8 illustrates an exemplary configuration of still another ion catcher 5*f*.

FIG. 8 illustrates an exemplary configuration of still another ion catcher 5*f*. A lower side of FIG. 8 may correspond to the upstream side of the reflected light 252 reflected by the EUV collector mirror 23.

The ion catcher 5*f* may include an inclined plate 55 and a plurality of curved plates 56 fixed to the inclined plate 55. These plates 56 may constitute a plurality of collision surfaces 57 and 58. As shown in FIG. 8, the plurality of collision surfaces 57 and 58 may not be parallel to the XY plane but be inclined. The plurality of plates 56 may be curved toward the upstream side of the optical path of the reflected light 252 reflected by the EUV collector mirror 23.

5. EUV Light Generation Device Including Tubular Ion Catcher

Figure 9:
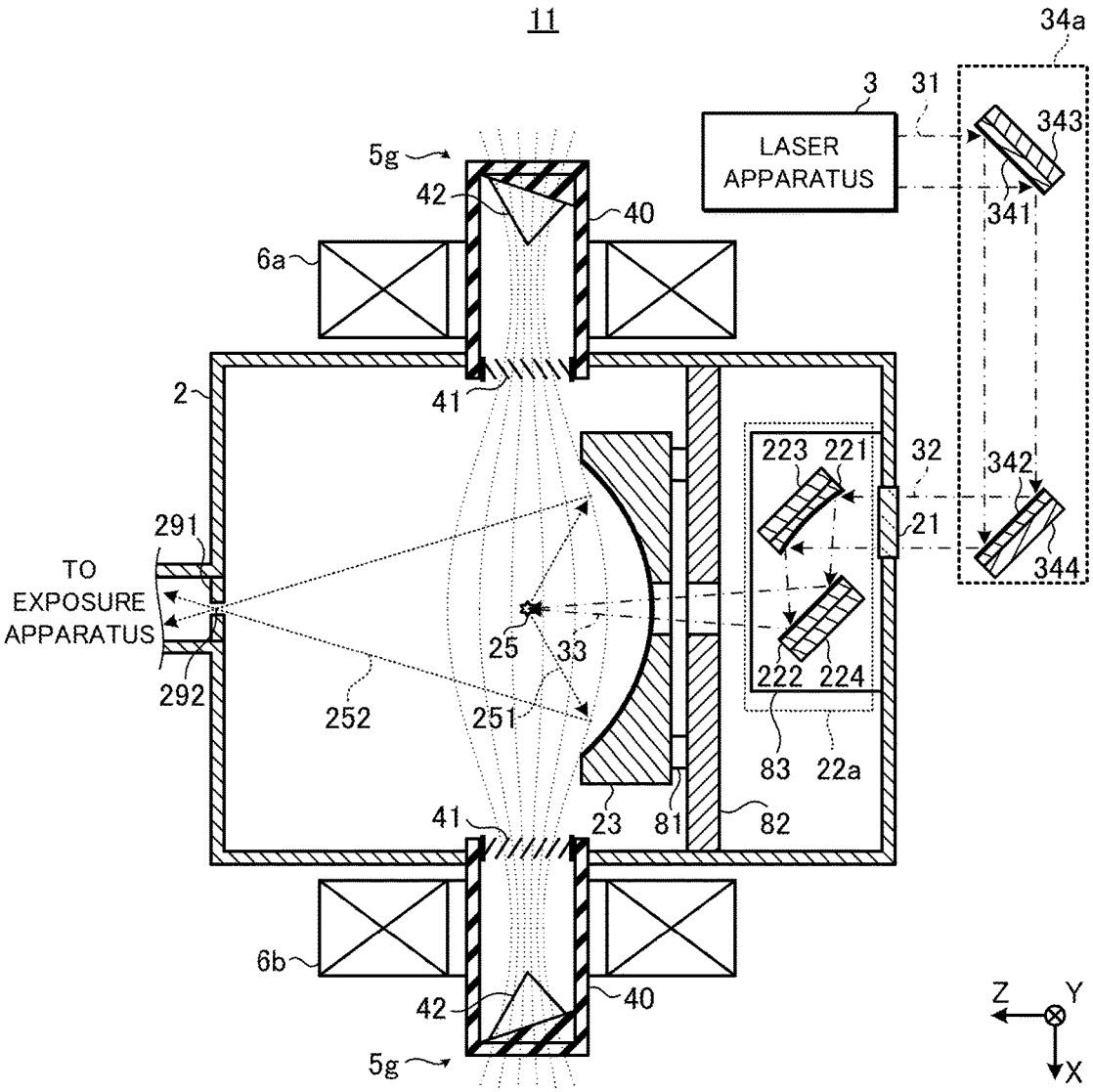
FIG. 9 is a partial cross-sectional view illustrating a configuration of an EUV light generation system 11 according to a second embodiment.

FIG. 9 is a partial cross-sectional view illustrating a configuration of an EUV light generation system 11 according to a second embodiment. Each of ion catchers 5*g* and 5*g* may include a tubular member 40, a first collision unit 41 provided at a first end of the tubular member 40, and a second collision unit 42 provided at a second end of the tubular member 40. In the following description, the first end of the tubular member 40 may be an end of the tubular member 40 that is closer to the plasma generation region 25. The first end of the tubular member 40 may have an opening in a direction along the magnetic field. The second end of the tubular member 40 may be an end of the tubular member 40 that is farther away from the plasma generation region 25.

Figure 10A:
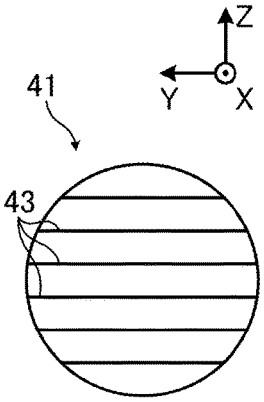
FIGS. 10A to 10C are enlarged views of a first collision unit 41 illustrated in FIG. 9.
Figure 10B:
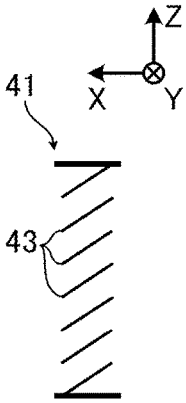
Figure 10C:
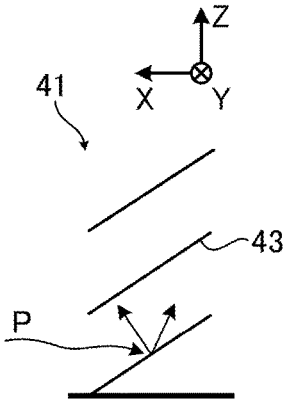

FIGS. 10A to 10C are enlarged views of the first collision unit 41 illustrated in FIG. 9. FIG. 10A is a view of the first collision unit 41 as seen from the direction parallel to the magnetic field. FIG. 10B is a side view of the first collision unit 41 illustrated in FIG. 10A. FIG. 10C is a partially-enlarged view of the first collision unit 41 illustrated in FIG. 10B. The first collision unit 41 may be constituted by a plurality of plate members 43 obliquely arranged at intervals. Each of the plate members 43 may have collision surfaces with which the ions or the neutral particles collide. The first collision unit 41 does not have to have a plate 55 (see FIGS. 4A to 4C).

Referring back to FIG. 9, the second collision unit 42 may have conical or polygonally-pyramidal surfaces. The tubular members 40 may be positioned through the bores of the coils constituting the respective magnets 6*a* and 6*b*. This may cause a strong magnetic field to be formed inside the tubular member 40.

When the ions or the neutral particles collide with and are reflected by any of the collision surfaces of the first collision unit 41, the first collision unit 41 may not be able to completely catch the ions or the neutral particles, with the result that the ions or the neutral particles may enter the tubular member 40. Here, the ions may be decelerated, since a strong magnetic field is formed inside the tubular member 40. The neutral particles may also be decelerated when being reflected by the first collision unit 41. Therefore, the ions or the neutral particles may easily adhere to the second collision unit 42 without being reflected by the second collision unit 42. If reflected by the second collision unit 42, the ions or the neutral particles are further decelerated. This reduces the possibility of the ions or the neutral particles passing through the first collision unit 41 again and returning to the inside of the chamber 2. That is, the inside of the tubular member 40 serves as a relaxation space in which the ions or the neutral particles are decelerated, thus making it possible to efficiently catch the ions or the neutral particles.

6. EUV Light Generation Device Whose Ion Catcher Includes Exhaust Pump 6.1 Gas Supply System FIG. 11 is a partial cross-sectional view illustrating a configuration of an EUV light generation system 11 according to a third embodiment.

Figure 11:
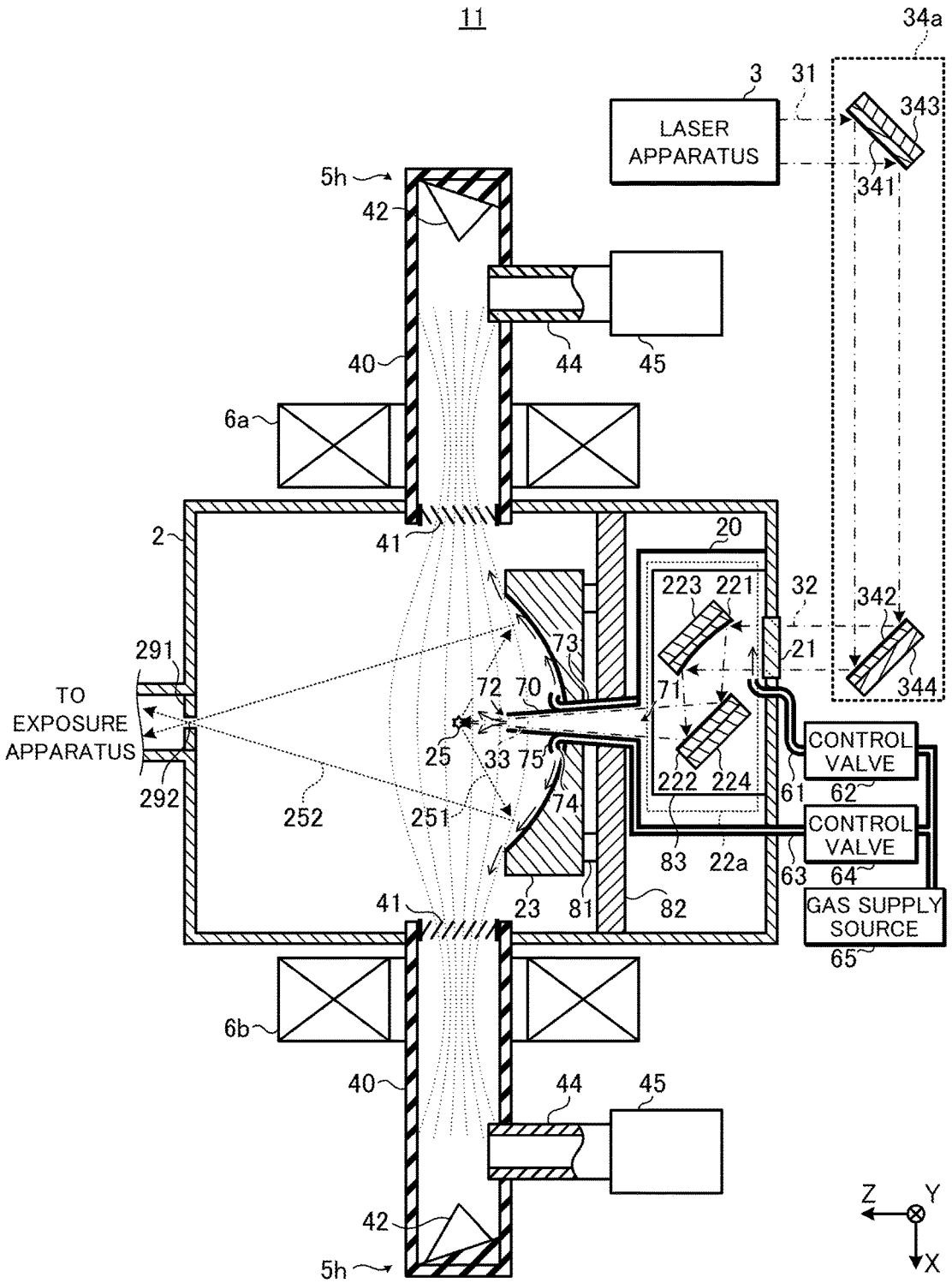
FIG. 11 is a partial cross-sectional view illustrating a configuration of an EUV light generation system 11 according to a third embodiment.

As shown in FIG. 11, a sub-chamber 20 may be provided inside the chamber 2. Pipes 61 and 63 may be attached to the chamber 2. Control valves 62 and 64 and a gas supply source 65 may be provided outside the chamber 2.

The plate 83 and the focusing optical system 22*a* may be housed within the sub-chamber 20. The sub-chamber 20 may include a hollow conical portion 70 penetrating the EUV collector mirror 23. The conical portion 70 may have openings at its base and at its tip, respectively. The pulse laser beam 33 may pass through the conical portion 70 from a base opening 71 to a tip opening 72 to reach the plasma generation region 25. That is, the sub-chamber 20, which includes the conical portion 70, may surround an optical path of the pulse laser beam 33 between the focusing optical system 22*a* and the plasma generation region 25.

An outer conical portion 73 may be located around the conical portion 70. There may be a space between the conical portion 70 and the outer conical portion 73. The outer conical portion 73 may also penetrate the EUV collector mirror 23. The outer conical portion 73 may include a return portion 74 spreading outward at an end near the reflective surface of the EUV collector mirror 23. Another return portion 75 may be fixed to an outer surface of the conical portion 70. There may be a space between the return portion 74 and the return portion 75. The space between the outer conical portion 73 and the conical portion 70 and the space between the return portions 74 and 75 may communicate with each other to form a gas passageway.

The gas supply source 65 may be connected to the inside of the sub-chamber 20 via the control valve 62 and the pipe 61.

The control valve 62 may be configured to be able to change the flow rate of hydrogen gas that is supplied to the pipe 61. The pipe 61 may have an opening inside the sub-chamber 20 and supply hydrogen gas to the vicinity of the window 21. The supply of hydrogen gas into the sub-chamber 20 may cause the pressure inside the sub-chamber 20 to be higher than the pressure inside the chamber 2 and outside the sub-chamber 20. The hydrogen gas supplied into the sub-chamber 20 may flow out from the tip opening 72 of the conical portion 70 toward an area around the plasma generation region 25.

Since the pressure inside the sub-chamber 20 is made higher than the pressure inside the chamber 2 by supplying the hydrogen gas into the sub-chamber 20, debris of the target material may be prevented from entering into the sub-chamber 20. If the debris of the target material adheres to the focusing optical system 22*a* and/or the window 21 inside the sub-chamber 20, the debris can be removed by etching with the hydrogen gas.

The gas supply source 65 may also be connected to the gas passageway in the space between the conical portion 70 and the outer conical portion 73 via the control valve 64 and the pipe 63.

The control valve 64 may be configured to be able to change the flow rate of hydrogen gas that is supplied to the pipe 63. The pipe 63 may be connected to the gas passageway formed in the space between the conical portion 70 and the outer conical portion 73 and supply hydrogen gas to the gas passageway. The hydrogen gas may flow out of the space between the return portions 74 and 75 radially from a central part of the EUV collector mirror 23 toward an outer circumferential side of the EUV collector mirror 23 along the reflective surface of the EUV collector mirror 23.

The flow of the hydrogen gas along the reflective surface of the EUV collector mirror 23 may prevent debris of the target material from reaching the reflective surface of the EUV collector mirror 23. If the debris of the target material adheres to the reflective surface of the EUV collector mirror 23, the debris can be removed by etching with the hydrogen gas.

6.2 Ion Catcher

Each of ion catchers 5*h* and 5*h* may include a tubular member 40, a first collision unit 41 provided at a first end of the tubular member 40, and a second collision unit 42 provided at a second end of the tubular member 40. The first collision unit 41 and the second collision unit 42 may be identical in configuration to those illustrated in FIG. 9.

An exhaust pump 45 may be connected to the tubular member 40 via an exhaust flow passage 44. Further, the possibility of the ions or the neutral particles being decelerated by colliding with an inner wall of the tubular member 40 may be increased by making the tubular member 40 comparatively long.

The exhaust pump 45 may exhaust the gas from the tubular member 40 to cause a difference in pressure between the inside of the chamber 2 and the inside of the tubular member 40 so that the ions or the neutral particles may be efficiently flown into the tubular member 40. Further, the exhaust pump 45 may exhaust the gas from the tubular member 40 to allow the ions or the neutral particles to be efficiently removed from the tubular member 40 by the exhaust pump 45. The exhaust pump 45 may be connected to a part of the tubular member 40 between a portion that is close to the second collision unit 42 and a middle portion of the tubular member 40. This allows the ions to be decelerated in the process of moving through the inside of the tubular member 40 or deactivated by being exposed to a gas flow, so that the ions may be efficiently removed by the exhaust pump 45.

7. EUV Light Generation Device Whose Ion Catcher Includes Gate Valves

Figure 12:
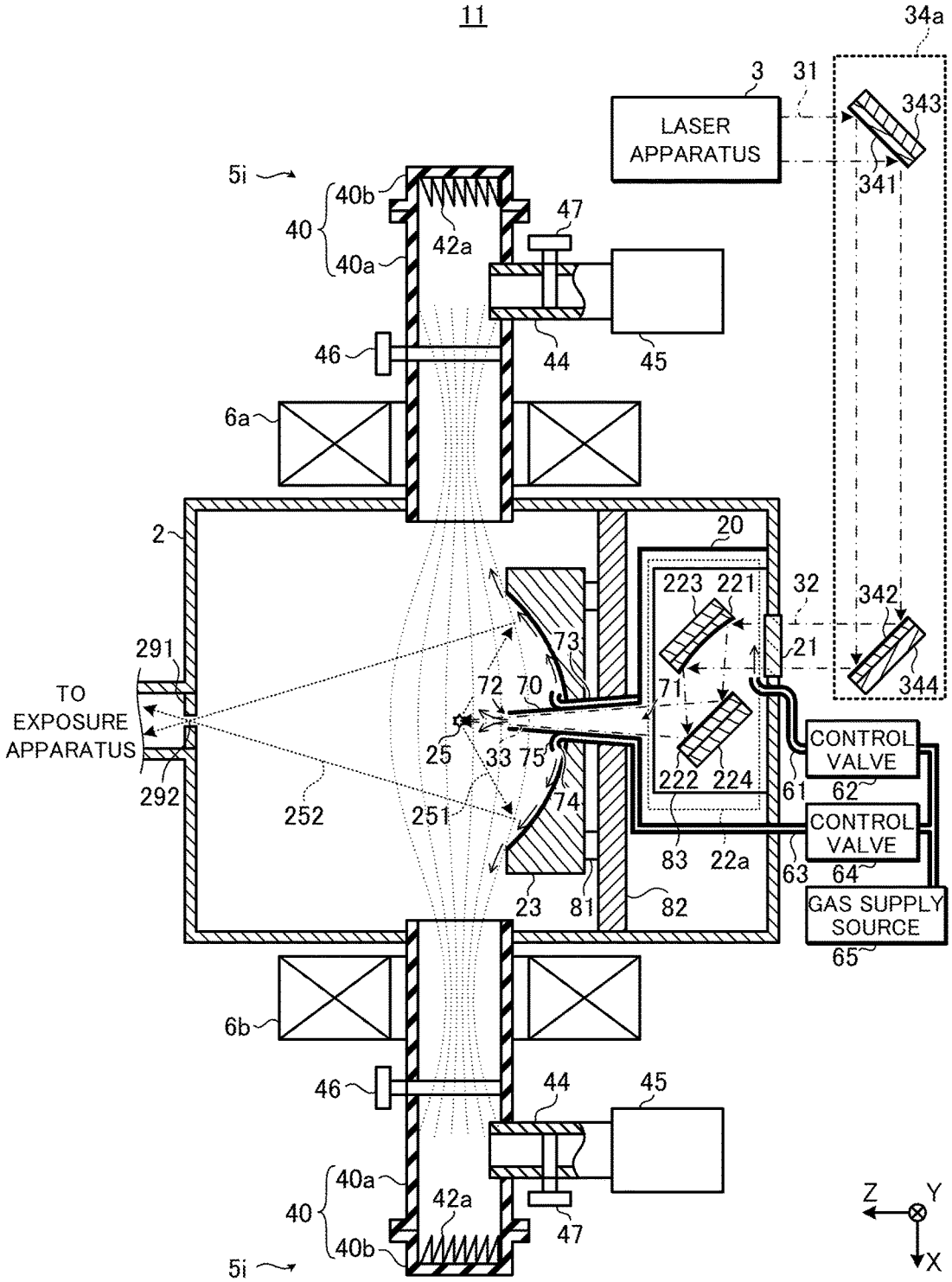
FIG. 12 is a partial cross-sectional view illustrating a configuration of an EUV light generation system 11 according to a fourth embodiment.

FIG. 12 is a partial cross-sectional view illustrating a configuration of an EUV light generation system 11 according to a fourth embodiment. A tubular member 40 constituting each of ion catchers 5*i* and 5*i* may include a first member 40*a* having a first end and a second member 40*b* having a second end. The second member 40*b* may be separable from the first member 40*a*. The first member 40*a* and the second member 40*b* may be fastened to each other by a bolt (not illustrated) so as to be hermetically fixed.

No collision unit may be provided at the first end of the tubular member 40. Although no collision unit is provided at the first end of the tubular member 40, the ions may be decelerated while moving through the inside of the tubular member 40 or deactivated by being exposed to a gas flow.

A collision unit 42*a* may be provided at the second end of the tubular member 40. The collision unit 42*a* may be provided with a plurality of deep grooves that are triangular in cross-section, and may be identical in configuration to the ion catcher 5*a* illustrated in FIG. 2 and FIGS. 3A to 3C.

A gate valve 46 may be provided near the middle of the tubular member 40. Further, a gate valve 47 may be provided in the exhaust flow passage 44, via which the exhaust pump 45 and the tubular member 40 are connected to each other. In the event of a replacement of the collision unit 42*a*, the gate valve 46 may be closed. In the event of maintenance of the exhaust pump 45, the gate valve 47 may be closed. This may suppress fluctuation in pressure inside the chamber 2 during the maintenance.

8. EUV Light Generation Device Whose Ion Catcher Includes Powder Pump

Figure 13:
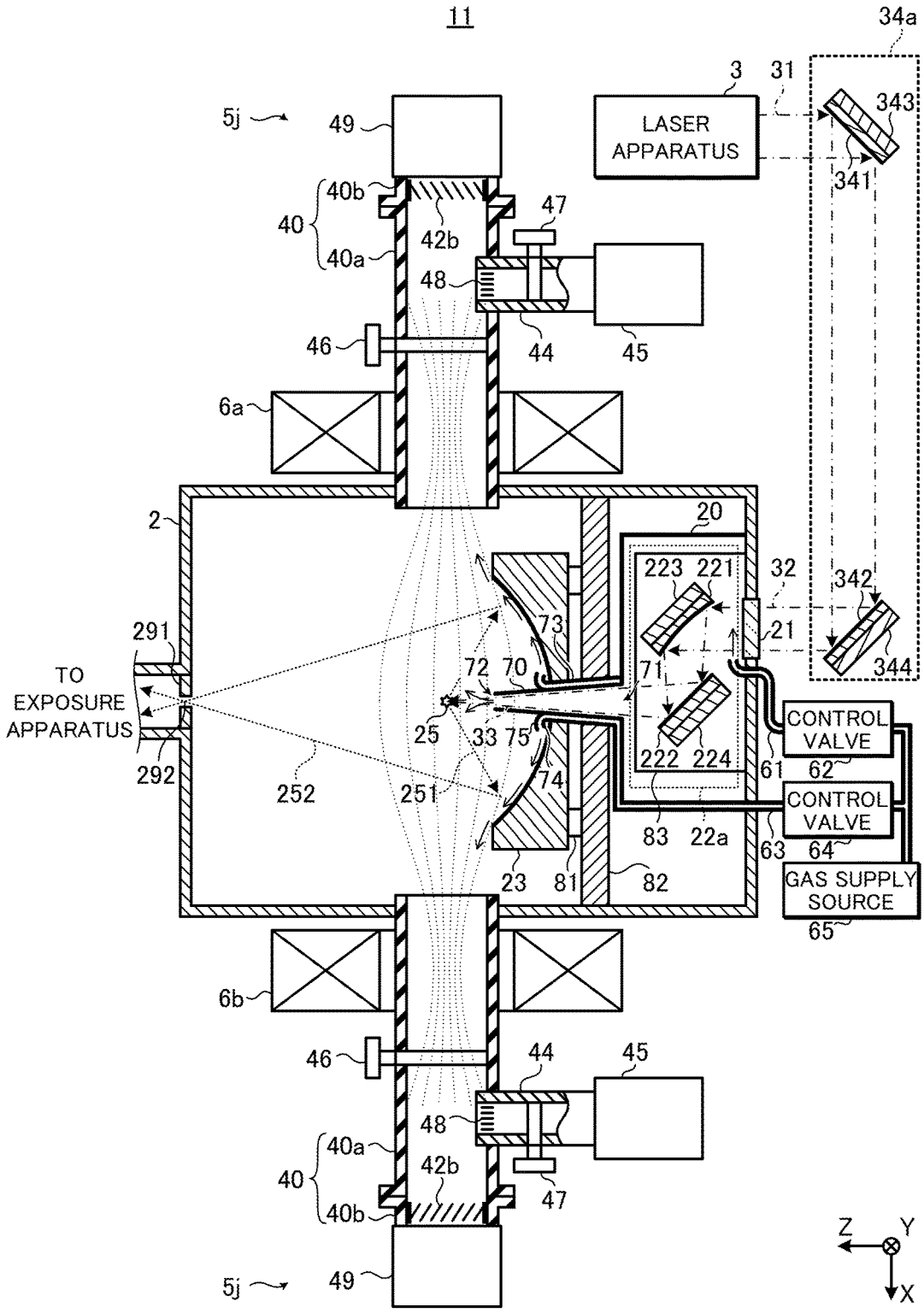
FIG. 13 is a partial cross-sectional view illustrating a configuration of an EUV light generation system 11 according to a fifth embodiment.

FIG. 13 is a partial cross-sectional view illustrating a configuration of an EUV light generation system 11 according to a fifth embodiment. A second member 40*b* of a tubular member 40 constituting each of ion catchers 5*j* and 5*j* may be provided with a powder pump 49. The powder pump 49 may be an apparatus that ejects a powder dispersed in gas. A collision unit 42*b* may be provided near a connection part connecting the powder pump 49 and the tubular member 40. The collision unit 42*b* may be an oblique arrangement of plate members, and may be identical in configuration to the first collision unit 41 illustrated in FIGS. 10A to 10C. Such a configuration of the collision unit 42*b* may allow the powder pump 49 to eject the powder.

Further, a powder filter 48 may be provided near a connection part connecting the tubular member 40 and the exhaust flow passage 44. This may prevent the powder from flowing into the exhaust pump 45, and an extension of the life of the exhaust pump 45 may be expected.

Figure 14:
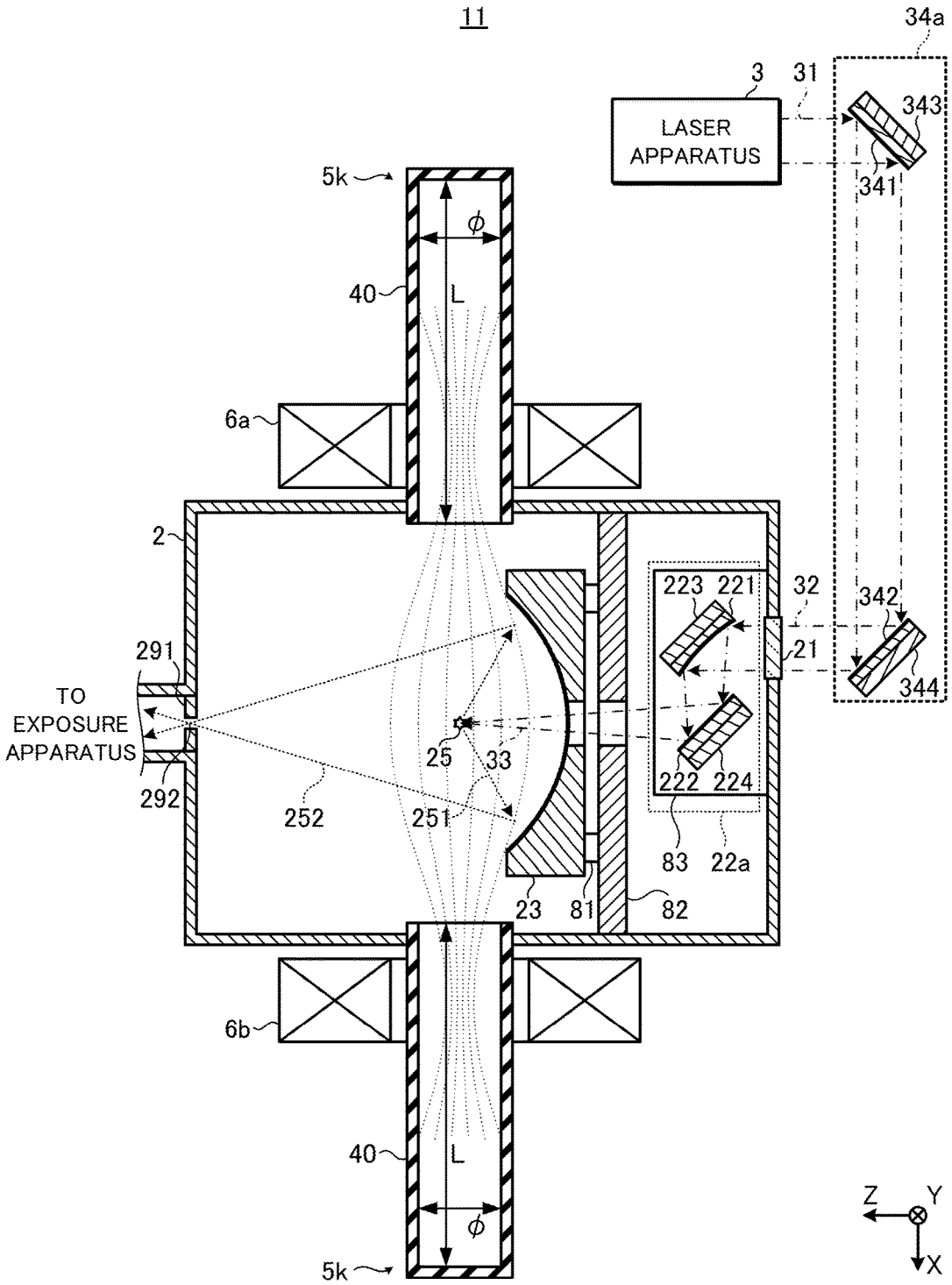
FIG. 14 is a partial cross-sectional view illustrating a configuration of an EUV light generation system 11 according to a sixth embodiment.

9. EUV Light Generation Device Including Ion Catcher Constituted by Tubular Member FIG. 14 is a partial cross-sectional view illustrating a configuration of an EUV light generation system 11 according to a sixth embodiment. In the sixth embodiment, each of ion catchers 5*k* and 5*k* may have a tubular member 40 provided with no exhaust pump. Further, no oblique collision surfaces may be provided inside the tubular member 40. Even without oblique collision surfaces, the tubular member 40 being sufficiently long may prevent the ions or the neutral particles from returning to the inside of the chamber 2.

Assuming that $\varphi$ is maximum diameter of the opening at the first end of the tubular member 40, convergent ion beam diameter by the magnetic field may preferably be equal to or smaller than $\varphi$. In this case, the convergent ion beam diameter may be defined as the diameter of a region where a cross-sectional number density distribution of the ions at the first end is equal to or greater than $1/e^2$ of a peak value. It may be assumed that L is the length of the tubular member 40 from the first end to the second end. It may further be assumed that the ions entering the tubular member 40 through the first end may reach the second end of the tubular member 40 and reflected particles or sputtered particles may isotropically disperse from the second end. Furthermore, out of the particles having isotropically dispersed from the second end, particles having dispersed into a range of a solid angle $\Omega$ may return to the inside of the chamber 2 through the first end of the tubular member 40. It may be assumed that particles having dispersed out of the range of the solid angle $\Omega$ from the second end are decelerated by colliding with the inner wall of the tubular member 40 at least once and adhere to the inner wall of the tubular member 40.

In this case, in order that particles returning to the inside of the chamber 2 account for less than 1% of the particles having isotropically dispersed from the second end, Eq. 1 may hold as follows:

$$\Omega/2\pi<0.01 \quad \text{(Eq. 1)}$$

$\Omega$ may be expressed by Eq. 2 as follows:

$$\Omega=2\pi(1-\cos\alpha) \quad \text{(Eq. 2)}$$

$\cos\alpha$ may be expressed by Eq. 3 as follows:

$$\cos\alpha=L/\sqrt{(L^2+\varphi^2/4)} \quad \text{(Eq. 3)}$$

It should be noted that $\sqrt{(X)}$ may be the positive square root of X.

Eq. 4 may be given from Eq. 1, Eq. 2, and Eq. 3 as follows:

$$L/\varphi>3.55 \quad \text{(Eq. 4)}$$

According to Eq. 4, the conditions to be satisfied by L and $\varphi$ may be defined in order that particles returning to the inside of the chamber 2 account for less than 1% of the particles having isotropically dispersed from the second end.

Further, in order that particles returning to the inside of the chamber 2 account for less than 0.3% of the particles having isotropically dispersed from the second end, Eq. 5 may be given in a manner similar to that described above:

$$L/\varphi>6.46 \quad \text{(Eq. 5)}$$

As explained above, preferably, the size of the tubular member may satisfy Eq. 4. More preferably, the size of the tubular member may satisfy Eq. 5. For example, if $\varphi$=81 mm and L=541.5 mm, Eq. 5 may be satisfied since $L/\varphi$=6.69.

Figure 15A:
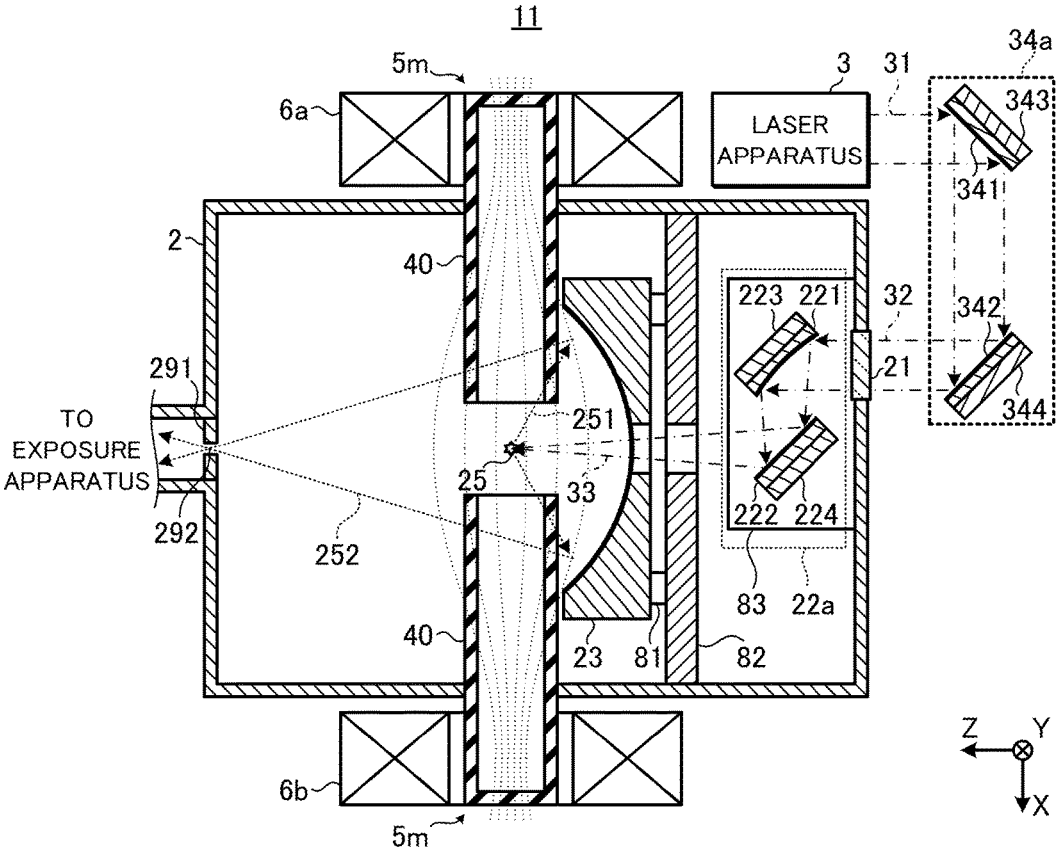
FIG. 15A is a partial cross-sectional view illustrating a configuration of an EUV light generation system 11 according to a seventh embodiment, the cross-section being parallel to a ZX plane and passes through a plasma generation region 25.
Figure 15B:
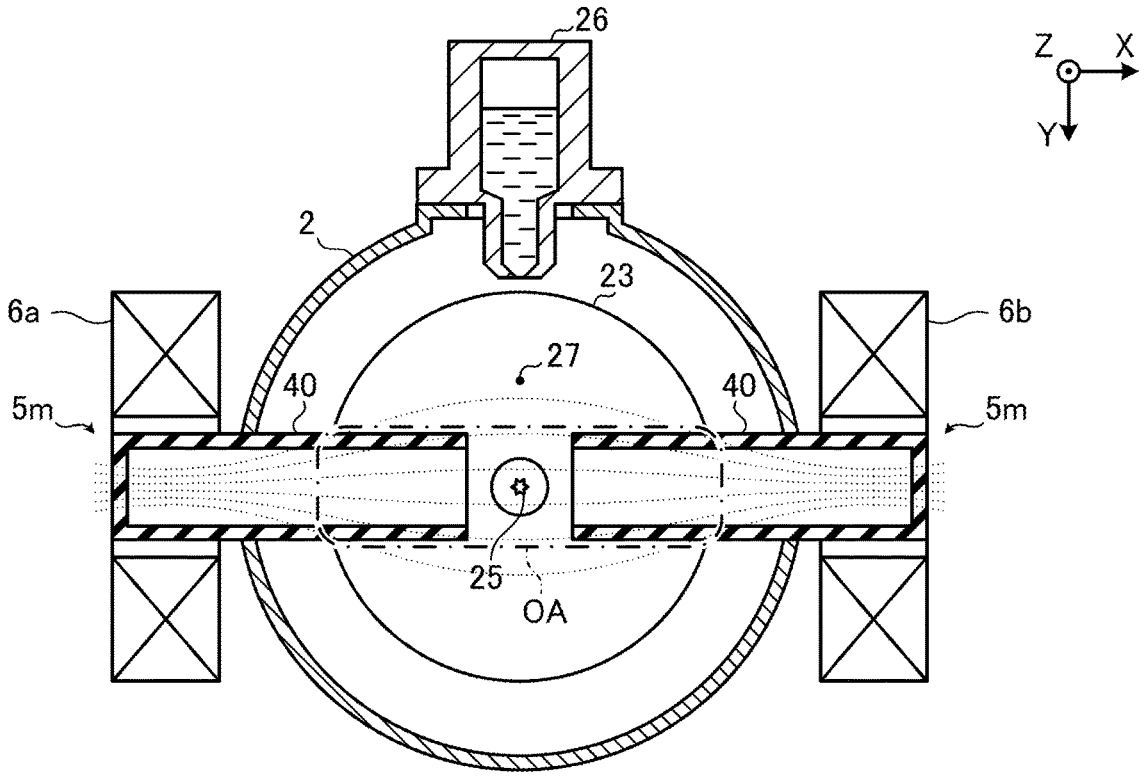
FIG. 15B is a partial cross-sectional view illustrating the configuration of the EUV light generation system 11 according to the seventh embodiment, the cross-section being parallel to an XY plane and passes through the plasma generation region 25.

10. EUV Light Generation Device Including Ion Catcher Disposed in Obscuration Area FIGS. 15A and 15B are partial cross-sectional views illustrating a configuration of an EUV light generation system 11 according to a seventh embodiment. FIG. 15A illustrates a cross-section that is parallel to the ZX plane and passes through the plasma generation region 25. FIG. 15B illustrates a cross-section that is parallel to the XY plane and passes through the plasma generation region 25.

According to a design of the exposure apparatus, the EUV light generation system 11 may have an obscuration area OA. The obscuration area OA may be a part of a beam region of EUV light that is not used for exposure. In this case, even in an optical path of the EUV light, ion catchers 5*m* and 5*m* may be provided in the obscuration area OA.

As shown in FIGS. 15A and 15B, a part of the tubular member 40 may be located inside the chamber 2. The part of the tubular member 40 may further be located in the obscuration area OA. This allows the first end of the tubular member 40 to be located near the plasma generation region 25. This allows the tubular member 40 to efficiently collect the ions contained in the plasma generated in the plasma generation region 25.

Figure 16A:
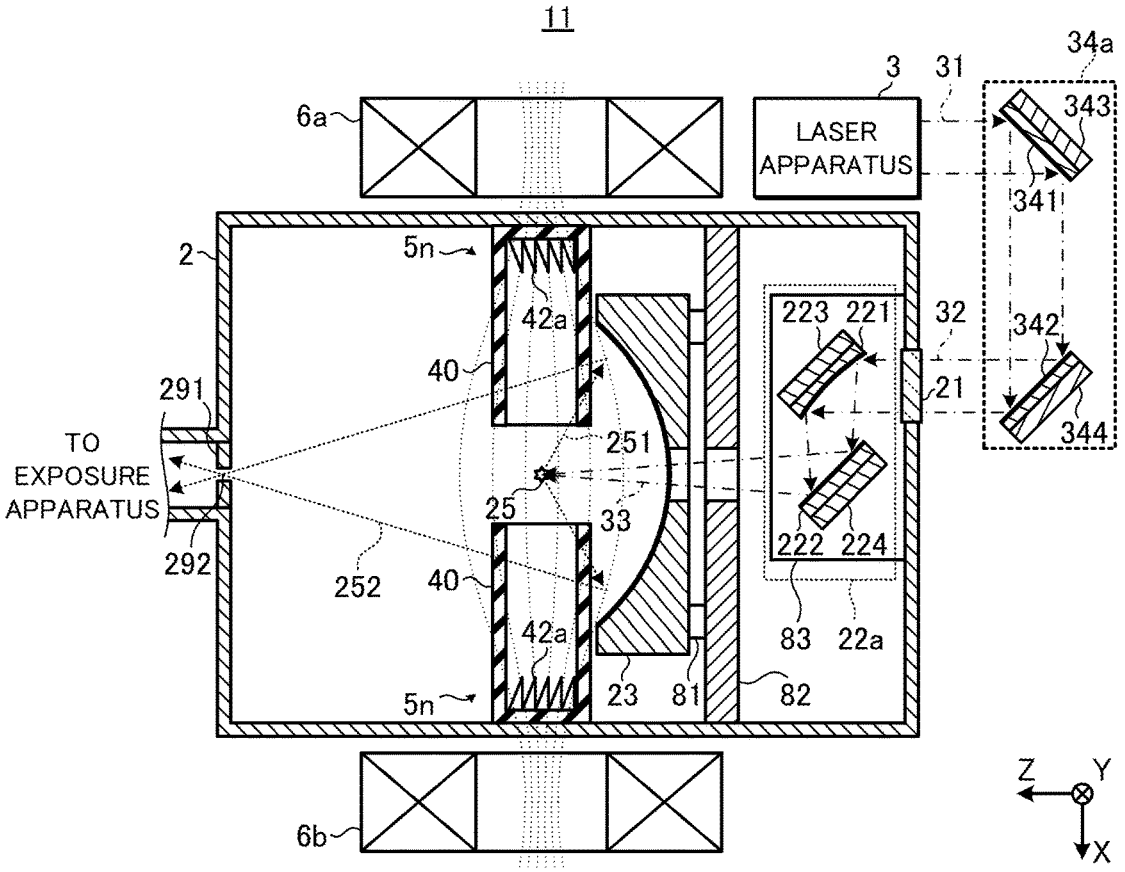
FIG. 16A is a partial cross-sectional view illustrating a configuration of an EUV light generation system 11 according to an eighth embodiment, the cross-section being parallel to the ZX plane and passes through the plasma generation region 25.
Figure 16B:
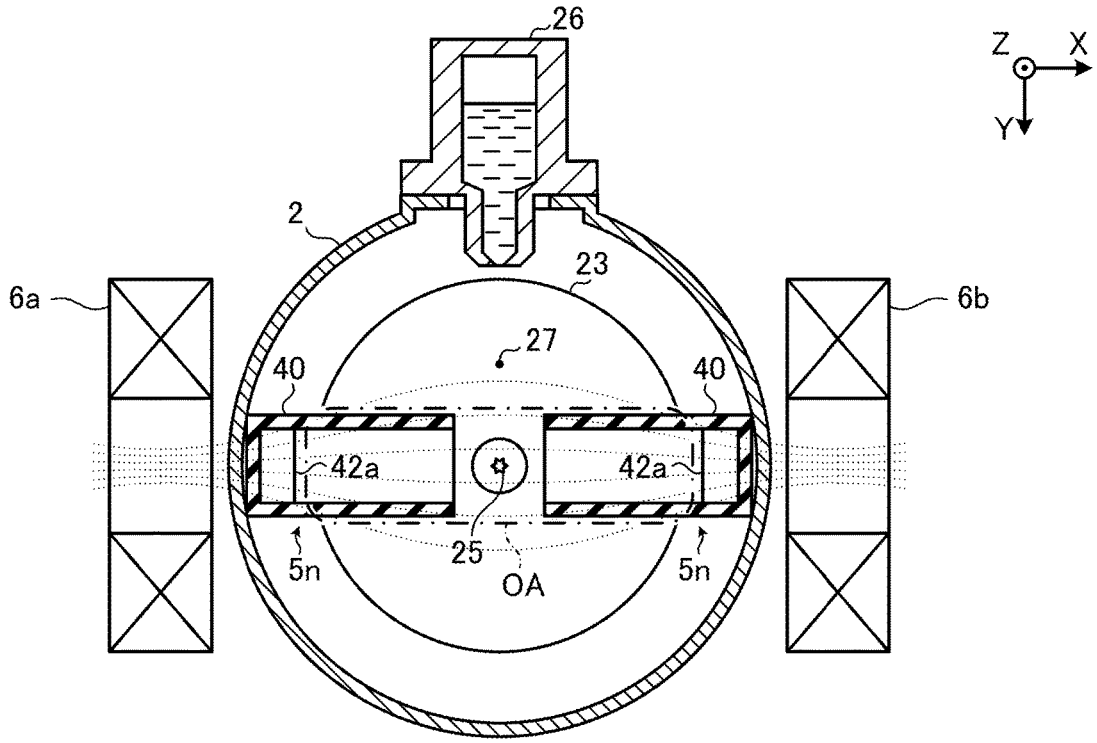
FIG. 16B is a partial cross-sectional view illustrating the configuration of the EUV light generation system 11 according to the eighth embodiment, the cross-section being parallel to the XY plane and passes through the plasma generation region 25.

FIGS. 16A and 16B are partial cross-sectional views illustrating a configuration of an EUV light generation system 11 according to an eighth embodiment. FIG. 16A illustrates a cross-section that is parallel to the ZX plane and passes through the plasma generation region 25. FIG. 16B illustrates a cross-section that is parallel to the XY plane and passes through the plasma generation region 25.

In the eighth embodiment, too, ion catchers 5*n* and 5*n* may be provided in an obscuration area.

As shown in FIGS. 16A and 16B, the tubular member 40 may be located inside the chamber 2. A part of the tubular member 40 may be located in the obscuration area OA. This allows the first end of the tubular member 40 to be located near the plasma generation region 25. This allows the tubular member 40 to efficiently collect the ions contained in the plasma generated in the plasma generation region 25.

A collision unit 42*a* may be provided at the second end of the tubular member 40. The collision unit 42*a* may be provided with a plurality of deep grooves that are triangular in cross-section, and may be identical in configuration to the ion catcher 5*a* illustrated in FIG. 2 and FIGS. 3A to 3C. This allows the tubular member 40 to efficiently collect the ions even when the tubular member 40 has such a length as to fall within the chamber 2.

According to the eighth embodiment, the tubular member 40 does not need to be disposed in the bores of the magnets 6*a* and 6*b*. This may prevent the tubular member 40 from becoming an obstacle, for example, to moving and replacing the chamber 2 with respect to the magnets 6*a* and 6*b*.

11. Shapes of Tubular Members

FIGS. 17A to 17I illustrate variations in the shapes of the tubular members 40 that are used in the embodiments described above. In each of the embodiments described above, a case has been described where the shape of the tubular member 40 is a cylindrical shape. However, the present disclosure is not limited to this case. In each of FIGS. 17A to 17I, the first end of the tubular member 40 may be shown on the upper side of the drawing, and the second end of the tubular member 40 may be shown on the lower side of the drawing.

Figure 17A:
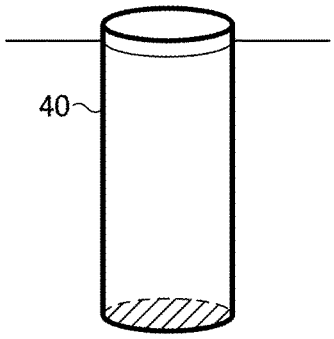
FIGS. 17A to 17I illustrate variations in the shapes of tubular members 40 that are used in the aforementioned embodiments.
Figure 17B:
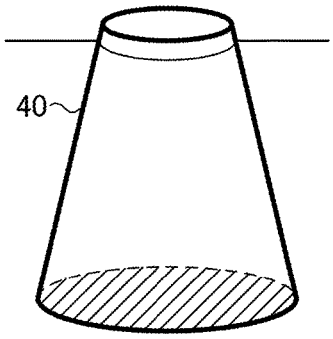
Figure 17C:
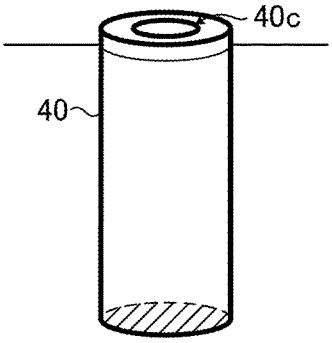

Instead of having a cylindrical shape such as that shown in FIG. 17A, the tubular member 40 may have a tapered shape such as that shown in FIG. 17B. Alternatively, as shown in FIG. 17*e*, the first end of the tubular member 40 may be partially closed except for a small opening 40*c*.

Figure 17D:
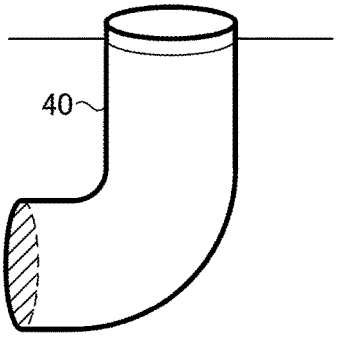
Figure 17E:
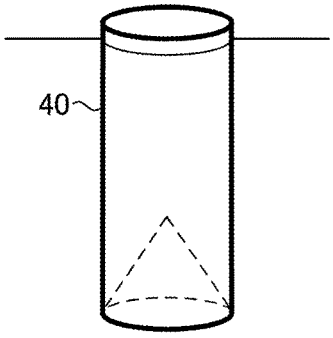
Figure 17F:
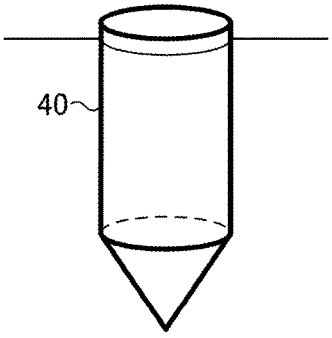

As shown in FIG. 17D, the tubular member 40 may be bent. As shown in FIGS. 17E and 17F, the tubular member 40 may include conical surfaces. In FIG. 17E, the tubular member 40 may have its second end depressed in a conical shape. In FIG. 17F, the tubular member 40 may have its second end projecting in a conical shape.

Figure 17G:
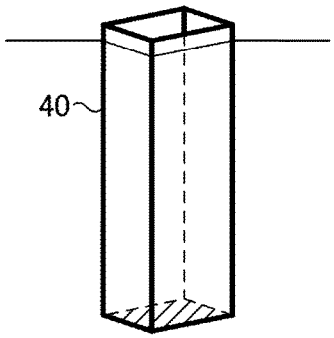
Figure 17H:
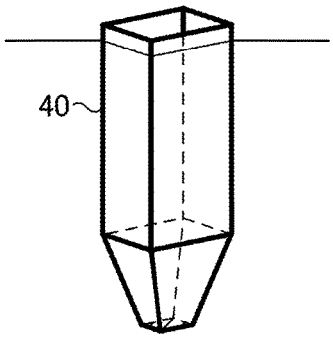
Figure 17I:
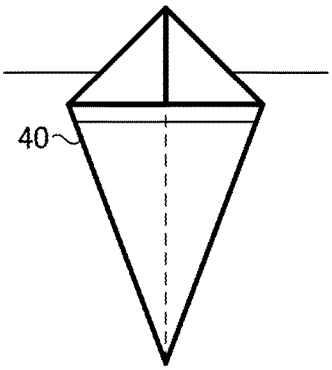

As shown in FIG. 17G, the shape of the tubular member 40 may be a polygonally-columnar shape. Alternatively, as shown in FIG. 17H, the tubular member 40 may include polygonally-pyramidal surfaces. Alternatively, as shown in FIG. 17I, the tubular member 40 may have a polygonally-pyramidal shape.

The above-described embodiments and the modifications thereof are merely examples for implementing the present disclosure, and the present disclosure is not limited thereto. It will be clear to those skilled in the art that making various modifications according to the specifications or the like is within the scope of the present disclosure, and other various embodiments are possible within the scope of the present disclosure.

The terms used in this specification and the appended claims should be interpreted as "non-limiting." For example, the terms "include" and "be included" should be interpreted as "including the stated elements but not limited to the stated elements." The term "have" should be interpreted as "having the stated elements but not limited to the stated elements." Further, the modifier "one (a/an)" should be interpreted as "at least one" or "one or more."

The invention claimed is:

1. An extreme ultraviolet light generation device for generating extreme ultraviolet light by irradiating a target with a pulse laser beam and thereby turning the target into plasma, comprising:

a chamber;

a magnet configured to form a magnetic field in the chamber; and an ion catcher including a collision unit disposed so that ions guided by the magnetic field collide with the collision unit, wherein the collision unit includes a plurality of collision surfaces disposed to be inclined with respect to the magnetic field.

2. The extreme ultraviolet light generation device according to claim 1, further comprising a collector mirror configured to reflect extreme ultraviolet light generated in the chamber and thereby concentrate the extreme ultraviolet light, wherein the plurality of collision surfaces are disposed to be inclined toward an upstream side of the extreme ultraviolet light reflected by the collector mirror.

3. The extreme ultraviolet light generation device according to claim 1, wherein the ion catcher includes a tubular member having a first end and a second end, the first end has an opening in a direction along the magnetic field, the collision unit is disposed between the first end and the second end, and the collision unit includes first and second collision units disposed near the first end and the second end, respectively.

4. The extreme ultraviolet light generation device according to claim 1, wherein the ion catcher includes a tubular member having a first end and a second end, the first end has an opening in a direction along the magnetic field, the collision unit is disposed between the first end and the second end, and the ion catcher is configured to satisfy a relationship $L/\varphi>3.55$, where L is the length of the tubular member from the first end to the second end and $\varphi$ is the maximum diameter of the opening of the tubular member.

5. The extreme ultraviolet light generation device according to claim 1, wherein the ion catcher includes a tubular member having a first end and a second end, the first end has an opening in a direction along the magnetic field, the collision unit is disposed between the first end and the second end, and the tubular member has a polygonally-columnar shape.

6. The extreme ultraviolet light generation device according to claim 1, wherein the ion catcher includes a tubular member having a first end and a second end, the first end has an opening in a direction along the magnetic field, the collision unit is disposed between the first end and the second end, the magnet is an electromagnet including a coil, and at least a part of the tubular member is disposed in a bore of the coil.

7. The extreme ultraviolet light generation device according to claim 1, wherein the ion catcher includes a tubular member having a first end and a second end, the first end has an opening in a direction along the magnetic field, the collision unit is disposed between the first end and the second end, and at least a part of the tubular member is disposed to project outside from the chamber.

8. An extreme ultraviolet light generation device for generating extreme ultraviolet light by irradiating a target with a pulse laser beam and thereby turning the target into plasma, comprising:

a chamber;

a magnet configured to form a magnetic field in the chamber; and an ion catcher including a collision unit disposed so that ions guided by the magnetic field collide with the collision unit; and an exhaust pump, wherein the ion catcher includes a tubular member having a first end and a second end, the first end has an opening in a direction along the magnetic field, the collision unit is disposed between the first end and the second end, and the exhaust pump is connected between the first end and the second end to exhaust gas out of the tubular member.

9. The extreme ultraviolet light generation device according to claim 8, wherein the collision unit includes conical or polygonally-pyramidal surfaces.

10. The extreme ultraviolet light generation device according to claim 8, wherein the collision unit includes first and second collision units disposed near the first end and the second end, respectively.

11. The extreme ultraviolet light generation device according to claim 8, wherein the ion catcher is configured to satisfy a relationship $L/\varphi>3.55$, where L is the length of the tubular member from the first end to the second end and $\varphi$ is the maximum diameter of the opening of the tubular member.

12. The extreme ultraviolet light generation device according to claim 8, wherein the tubular member has a polygonally-columnar shape.

13. The extreme ultraviolet light generation device according to claim 8, wherein the magnet is an electromagnet including a coil, and at least a part of the tubular member is disposed in a bore of the coil.

14. The extreme ultraviolet light generation device according to claim 8, wherein at least a part of the tubular member is disposed to project outside from the chamber.

15. An extreme ultraviolet light generation device for generating extreme ultraviolet light by irradiating a target with a pulse laser beam and thereby turning the target into plasma, comprising:

a chamber;

a magnet configured to form a magnetic field in the chamber; and an ion catcher including a collision unit disposed so that ions guided by the magnetic field collide with the collision unit, wherein the ion catcher includes a tubular member having a first end and a second end, the first end has an opening in a direction along the magnetic field, the collision unit is disposed between the first end and the second end, and the tubular member has a tapered shape.

16. The extreme ultraviolet light generation device according to claim 15, wherein the collision unit includes first and second collision units disposed near the first end and the second end, respectively.

17. The extreme ultraviolet light generation device according to claim 15, wherein the ion catcher is configured to satisfy a relationship $L/\varphi>3.55$, where L is the length of the tubular member from the first end to the second end and $\varphi$ is the maximum diameter of the opening of the tubular member.

18. The extreme ultraviolet light generation device according to claim 15, wherein the collision unit includes conical or polygonally-pyramidal surfaces.

19. The extreme ultraviolet light generation device according to claim 15, wherein the magnet is an electromagnet including a coil, and at least a part of the tubular member is disposed in a bore of the coil.

20. The extreme ultraviolet light generation device according to claim 15, wherein at least a part of the tubular member is disposed to project outside from the chamber.

* * * * *